United States Patent [19]

Fishman et al.

[11] Patent Number: 4,583,667

[45] Date of Patent: Apr. 22, 1986

[54] PARTITIONING DISPENSING CONTAINER

[75] Inventors: A. Harry Fishman, Hewlet Harbor, N.Y.; Joseph Bottitta, Belleville, N.J.

[73] Assignee: APL Corporation, Miami Beach, Fla.

[21] Appl. No.: 566,054

[22] Filed: Dec. 27, 1983

[51] Int. Cl.[4] ..... B65D 83/04

[52] U.S. Cl. ..... 222/142.6; 222/44; 222/553; 206/538; 220/20

[58] Field of Search ..... 222/44, 48, 142.1, 142.6, 222/142.9, 553, 142.8; 221/5; 206/538; 220/20

[56] References Cited

U.S. PATENT DOCUMENTS

| | | | |
|---|---|---|---|
| 2,328,246 | 8/1943 | Albion | 222/553 |
| 2,526,308 | 10/1950 | Vorsanger | 222/142.9 |
| 2,555,047 | 8/1951 | Logue | 239/24 |
| 2,831,600 | 4/1958 | Powers | 222/562 X |
| 3,207,390 | 9/1965 | Short | 222/553 |
| 3,876,269 | 4/1975 | Fisher et al. | 312/234.1 |
| 3,878,971 | 4/1975 | Freedman | 222/142.6 |
| 4,261,468 | 4/1981 | Krebs | 206/538 |
| 4,288,006 | 9/1981 | Clover | 222/142.9 X |

*Primary Examiner*—Joseph J. Rolla

*Assistant Examiner*—Frederick R. Handren

*Attorney, Agent, or Firm*—Caesar, Rivise, Bernstein & Cohen, Ltd.

[57] ABSTRACT

A dispensing container for dispensing a plurality of different types of items, e.g., vitamins. The container is constructed to include a jar and a releasably securable lid. The jar includes vertically disposed and radially extending partitions to establish a plurality of separate chambers, each adapted for storing a different type or a combination of items. The jar portion further includes a plurality of passages, with each passage being in communication with a respective chamber. The lid includes a downwardly extending sidewall having a dispensing slot located therein. The lid is releasably and rotatably secured to an upper portion of the jar by an annular projection on the sidewall of the jar which engages an annular recess on the inside of the sidewall of the lid. Accordingly, as the lid is manually rotated, the dispensing slot can be brought to overlie a respective passage in the jar portion to permit the dispensing of an item from the associated chamber. The lid further includes parallel ribs, which engage a portion of the jar to align the dispensing slot with respective passages.

7 Claims, 4 Drawing Figures

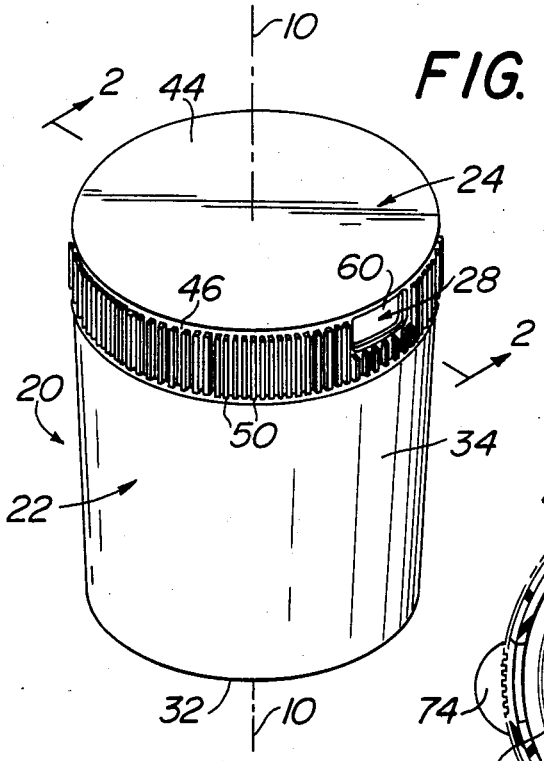
FIG. 1
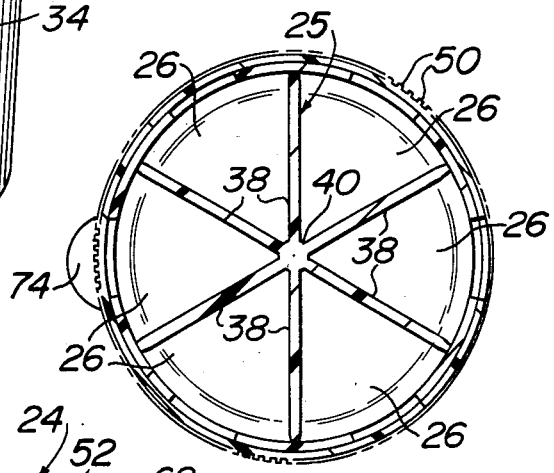
FIG. 3
FIG. 2
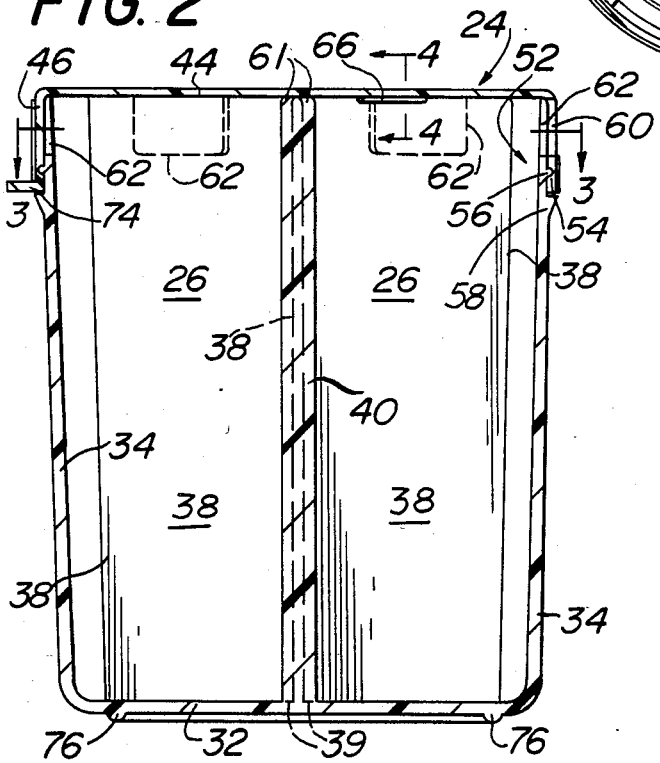
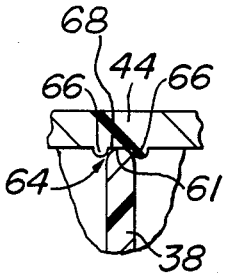
FIG. 4

PARTITIONING DISPENSING CONTAINER

BACKGROUND OF THE INVENTION

This invention relates generally to dispensing containers and more particularly to a multi-chambered dispensing container.

In today's society many people consume a variety of different types of vitamins, pills, capsules, tablets or other medicines (hereinafter generally referred to as pills) on a regular basis. Consequently, there is a substantial need for a dispensing device which facilitate both the storing and dispensing of those pills. In particular, there is a need for a device which includes a plurality of isolated chambers, each adapted to contain a different type or group of pills, so as to obviate the need for using separate bottles or dispensing containers for each group. A dispensing device should further ensure that the pills contained in respective chambers do not accidentally spill from the device, become contaminated from the external environment or accidentally pass into other chambers within the device, at such time that the pills are being stored therein.

It should be pointed out that a dispensing container as such is also readily adapted to be used for dispensing other types of individual items as well as pills, e.g., condiments, mechanical parts, etc. To that end, in the prior art there is disclosed a variety of pill and other types of segregated or multi-chambered dispensing containers. For example, in U.S. Pat. No. 2,526,308 (Vorsanger) there is disclosed a multiple compartment condiment holder comprising a jar having six radially extending vertical partitioning walls dividing the jar into six wedge-shaped chambers. Each chamber is open at its top and is adapted to hold a particular condiment therein. A screw cap is disposed over the top of the jar and includes an opening which is arranged to be rotatably positioned, to provide a passageway communicating with the interior of an underlying chamber, thus enabling the contents of that chamber to be dispensed through the opening. By virtue of the dispensing opening being located in the top of the cap, use of the device is rendered somewhat awkward e.g., dispensing requires a twisting motion of the hand and arm in order to remove or pour the contents from the container. Moreover, the Vorsanger device also lacks convenient alignment means for aligning the dispensing openings with respective chambers to facilitate dispensing.

In U.S. Pat. No. 3,876,269 (Fisher et al.) there is disclosed a pre-programmed medication dispenser. The Fisher device includes a central portion having a plurality of chambers, with said chambers projecting outward from a central hub, to a side opening. The central portion of the device is disposed within a sleeve or ring having an access opening therein. The access opening is arranged to be rotated to expose selected groups of chambers to enable the medicine in those selected groups of chambers to be dispensed side-ways through the sidewall of the device. Although the Fisher device is generally suitable for its intended purpose, it should readily be appreciated that its structure is extremely complex and undoubtedly expensive to manufacture.

In U.S. Pat. No. 2,555,047 (Logue) there is disclosed a multi-compartment sachet holder which includes a hollow cylindrical housing having three wedge-shaped chambers formed therein. Each chamber includes a sidewall portion having a recess therethrough. A rotary cap which includes a peripheral flange having a sidewall opening is disposed over the housing. The cap is arranged to rotate about the periphery of the cylinder, causing the opening to overlie selected recesses to form passageways between the exterior of the housing and the chambers associated with those recesses. Although the Logue device appears generally suitable for its intended purpose, it does not include various constructional features, e.g., convenient alignment means, to ensure the efficient dispensing of individual ones of a plurality of pills or other types of items.

OBJECTS OF THE INVENTION

Accordingly, it is a general object of the instant invention to provide a dispensing container which overcomes the disadvantages inherent in the prior art dispensing containers.

It is another object of the invention to provide a dispensing container which includes a plurality of separate and isolated chambers to enable an individual to dispense a plurality of different types of pills or other items in selected combinations, one at a time, as desired.

It is a further object of the instant invention to provide a dispensing container which includes alignment means, rotatable connecting means and various other features which serve to enhance the ease with which a person can use the container to dispense individual items therefrom.

It is still a further object of the invention to provide a compact, partitioned dispensing container which is simple in construction, inexpensive to produce and readily used for storing and dispensing individual items.

SUMMARY OF THE INVENTION

These and other objects of the instant invention are achieved by providing a partitioned dispensing container which can be used to separately store and dispense a plurality of different groups of individual items, such as pills. The container is in the form of a hollow jar having a sidewall, a bottom wall and an open top. A portion of the sidewall is cylindrically shaped and includes a plurality of passages circumferentially spaced therearound. The jar also includes vertically disposed partitioning means dividing the jar's interior space into a plurality of separate and isolated chambers. Each chamber is adapted to receive and hold therein plural items to be dispensed. The container also includes lid means releasably and rotatably mounted on the jar adjacent the top so as to close the jar's chambers. The lid means includes a top wall and an annular sidewall. The sidewall includes a dispensing slot of a sufficient size to enable any item disposed within any chamber to pass therethrough. The annular sidewall is located to selectively cover the passages in the jar's sidewall to enable an item to be dispensed from a selected chamber when the lid means is rotatably positioned so that said slot overlies the passageway thereof while the sidewall of the lid means closes the other passages, thereby precluding dispensing of items from the chambers associated with the closed passages. The container also includes alignment means for facilitating the process of aligning the dispensing slot with the respective passages. The alignment means includes engagement means on said lid means and arranged to coact with one of selected portions of said jar. When the cap means is rotated to a first position to align the dispensing slot with one of said passages, said engagement means resists accidental rotational movement of the lid means with respect to said jar which would tend to misalign said slot and said passage. Said engagement means being releasable by the application of additional rotary force to said lid means to cause said first engagement means to be disengaged from said one selected portion of said jar, thereby enabling the lid means to rotate to a second position of alignment between another one of said passages and the dispensing slot, thus permitting access to another of the chambers.

DESCRIPTION OF THE DRAWING

FIG. 1 is perspective view of a partitioned dispensing container constructed in accordance with the teachings of this invention;

FIG. 2 is an enlarged sectional view of the container taken along line 2—2 of FIG. 1;

FIG. 3 is a sectional view of the container taken along line 3—3 of FIG. 2; and FIG. 4 is an enlarged sectional view of the container taken along line 4—4 of FIG. 2.

DETAILED DESCRIPTION OF PREFERRED EMBODIMENT

Referring now to the various figures of the drawing wherein like reference characters refer to like parts, there is shown at 20 in FIG. 1 a partitioned dispensing container constructed in accordance with the teachings of the instant invention.

The dispensing container 20 facilitates the storing and dispensing of individual elements such as vitamins, pills or other medicines, prior to their being ingested or otherwise used by an individual. Furthermore, the container 20 is also readily used for dispensing other non-medicinal types of substances or items e.g., condiments, hardware fasteners, washers, etc.

As shall be discussed in greater detail later, the container 20 is constructed to include a plurality of chambers, each adapted to be filled with a different type of plural items. For instance, one chamber might include Vitamin A tablets, another chamber might include Vitamin B tablets, etc. Thus, for application in which a person takes more than one type of vitamin, the need for utilizing several different medicine bottles or dispensing containers is eliminated. Needless to say this results in a significant convenience to the user.

Alternatively, the container may be used for dispensing a variety of different types of medicines by having each respective chamber pre-filled with the exact number and combination of pills which are to be taken at a given time or within a given period. Thus, the person could be sure of taking the proper number and combination of pills by emptying an entire chamber of all of its pills at each dosage interval, without having to count or otherwise determine which pills are to be taken at that time. This aspect of the invention is particularly useful, for example, with regard to eldery persons who take several types of pills at a time, since the dispenser could readily be filled in advance by someone else, to avoid the possibility of the eldery person taking the incorrect number or combination of pills.

Referring to FIG. 1, it can be seen that container 20 basically comprises a hollow body or jar 22 and a cover or lid 24 therefore. The jar 22 will be described in considerable detail later, suffice for now to state that it is a generally hollow member which is divided into plural separate and isolated chambers 26 (FIGS. 2 and 3). Each chamber is adapted to hold therein a plurality of items, such as vitamins, to prevent the intermingling of the items of one chamber with those of another chamber. The lid 24 will also be described in detail later, suffice for now to state that it is arranged to be releaseably secured to the jar to close off and seal each of the chambers. The lid includes dispensing means 28, in the form of a slot which is arranged to be moved into communication with an associated chamber to provide an egress passageway for the items in the chamber. In particular, the lid is arranged to communicate with corresponding dispensing passages in the jar's chambers to permit individual items to be dispensed from the chambers as desired. Moreover the dispensing means is arranged to insure that individual items from not more than one of the chambers are dispensed from the container at a given time, with the particular chamber from which the items are dispensed being dependent upon the rotational position of the lid with respect to the jar.

Referring to FIG. 2, the jar 22 is in the form of a cylindrically shaped vessel including a generally planar bottom wall 32, and an annular circular sidewall 34. The top of the jar is open. Although the term jar often suggests a glass container, such is not intended for purposes of this patent application, inasmuch as the jar portion 22 can readily be constructed of a wide variety of different materials including but not limited to glass. In the preferred embodiment of the invention, the jar portion as well as the lid means are constructed of plastic.

As noted earlier the jar includes plural separate chambers 26. The chambers are formed by partitioning means 25 in the interior of the jar and comprise a plurality of vertically disposed walls 38 and a vertically extending hub 40. The hub is located along the central longitudinal axis 10 (FIG. 1) of the jar. The respective walls 38 each extend outward in a radial direction from the hub, at equally spaced locations about the hub's periphery, to join with the jar's curved sidewall 34. As can be seen in FIG. 2, the bottom 39 of each vertical wall 38 meets the bottom 32 of the jar. Moreover each wall 38 extends upward from the bottom 32 for substantially the entire height of the jar (e.g., to the plane defined by the circular top edge of the sidewall 34). The partitioning walls 38 and hub 40 thus combine with the bottom wall 32 and sidewall 34 of the jar portion to form a plurality of separate and generally isolated chambers 26 within the jar. The top of the respective chambers 26 are open when the lid 24 is removed from the jar 22 and are sealed or covered by the lid when the lid is secured thereto, as shall be described in greater detail later.

In the preferred embodiment of the invention, there are six partitioning walls 38, with each partitioning wall forming an angle of approximately 60° with its immediately adjacent wall 38. Thus, the partitioning walls of the preferred embodiment form six generally wedge-shaped sectors or chambers 26 of equal size and shape. Obviously, alternative embodiments of the invention can include almost any number of chambers as desired and may further include chambers of different sizes and shapes to accommodate items of a particular size or shape, or a specific quantity of some item or items.

Each chamber includes a respective egress passage 62 in the form of a recess in the sidewall 34 of the jar contiguous with the top edge thereof. Each passage is arranged to cooperate with the cap's dispensing slot to enable the ready dispensing of a single item disposed within its associated chamber, as will be described later.

The lid 24 is a generally disk-like member and includes a solid, circular top wall 44 and an annular sidewall 46 depending from the top wall 44. The lid is snap fit over the open top of the jar 22 to seal the jar. When mounted on the jar the lid is arranged to be rotated with respect to the jar. To that end the lid includes connecting means 52. The connecting means 52 is in the form of a circumferential recess 54, extending completely around the lower portion of the inside surface of the lid's side wall 46. The recess coacts with a mating annular projection 56, extending completely around the periphery of an upper portion of the jar's sidewall 34. Thus, the recess 54 is arranged to receive and mate with the projection 56, so as to releasably secure the lid to the jar, yet permitting the lid to rotate with respect to the jar about axis 10.

As can be seen clearly in FIG. 2, the jar also includes a flared annular ledge portion 58 adjacent and slightly beneath the annular projection 56, so as to form a smooth interface between the jar wall and the bottom edge of the lid. The flared portion 58 is closely adjacent but does not abut the lid, so as not to interfere with the lid's rotational movement.

As shown in FIG. 1, the lid 26 also includes a gripping surface 50 disposed about the entire outer periphery of the sidewall 46 to enhance the ease with which the lid may be manually grasped, held or twisted. More specifically, the gripping surface 50 comprises a plurality of parallel, vertically extending ribs of generally rectangular shape.

The dispensing means 28 basically comprises a single, generally rectangular slot 60 located in the lid's sidewall 46. As noted earlier that slot is arranged to cooperate with one of the egress passages 62 in the jar's sidewall to enable the dispensing of an individual item from the associated chamber. Thus, there are in the embodiment disclosed herein six dispensing passages 62. Each of the dispensing passages is of the same size and shape as the slot 60 and are oriented so that their major dimension is directed horizontally.

Although the container 20 is readily used for storing and dispensing vitamins pills or other items of different size and shape, in the preferred embodiment of the invention the slot 60 and passages 62 are only slightly larger than a typical vitamin dispensed by the container, so as to allow only a single vitamin at a time to pass therethrough. Thus, the preferred embodiment of the invention includes a dispensing slot 60 and passages 62 whose dimensions are 1 cm. high by 2 cm. wide.

The dispensing passages 62 are located at circumferentially spaced locations around the periphery of the jar's sidewall 34. In this regard, in the preferred embodiment of the invention, each passage 62 is in direct physical communication with, e.g., is open to, a respective one of the six chambers 30. When the lid is connected to the jar portion in the manner described above, the dispensing slot 60 is located at precisely the same vertical position (e.g., height) as the passages 62 in the jar's sidewall. Therefor, as the lid 26 is rotated about the central axis 10 (FIG. 1), the dispensing slot 60 sequentially overlies respective apertures 62. Thus, items are dispensed from any one of the six chambers 30 by positioning (e.g., rotating) the lid so that the dispensing slot 60 overlies the passage 62 associated with the selected chamber, and then tilting (e.g., orienting approximately 60° from vertical) and/or shaking the container, to cause one or several of the items to pass through the passage 62 and slot 60 to the exterior of the container, one item at a time.

It should further be appreciated from FIG. 2 that the lid is arranged so that when it is connected to the jar portion, its top wall 44 is closely adjacent or abuts the top edges 61 of the partitioning walls 38, thus precluding any of the vitamins stored in the chamber or a significant amount of powder which may come off the vitamins from passing between adjacent chambers 30.

To facilitate the process of aligning the dispensing slot 60 with respective passages 62, the container further includes alignment means 64 (FIG. 4). The alignment means basically comprises a pair of radially extending ribs 66 located along the underside surface of the lid's top wall 44. The ribs 66 are arranged parallel to each other and positioned so as to be at radially intermediate locations on the wall 44, i.e., each rib is at a substantial distance from both the lid's periphery and the central axis 10 of the lid's top wall. Furthermore, the two ribs are of beveled cross section to form a shallow but elongated channel 68, therebetween. The channel 68 is adapted to receive respective top edges 61 of the partitioning walls 38, to releasably secure the lid to the jar portion 22 at various predetermined rotational positions.

In this regard, the ribs are located so that when a partitioning wall 38 engages the ribs 66, e.g., is situated within the channel 68, the dispensing slot 60 is located at a rotational position whereby it is precisely aligned with one of the six passages 62. Furthermore, it should be appreciated that when the lid is rotated to the next or another rotational position in which the top edge of another wall 38 of the partitioning means and the alignment means 64 engage each other, the dispensing slot 60 is again precisely positioned to overlie another one of the six passages 62. This relationship holds true for each wall 38 and passage 62, as the lid rotates, so as to readily permit the dispensing slot 60 to be aligned with each of the six passages 62 in sequence.

As will be appreciated, when the alignment ribs 66 and partitioning means 25 are not in engagement with each other, the dispensing slot 60 does not overlie any of the six passages 62. Hence the solid portion of the sidewall 46 blocks or seals each of those passages and in so doing denies access to all six of the container's chambers 30.

As can be seen in FIG. 3 the lid also includes tab means in the form of a curved, planar tab member 74, which extends radially outward in a horizontal plane from the lid's sidewall, at a location generally opposite the slot 60. The tab member 74 facilitates removal of the lid from the jar portion, to enable a person to quickly and easily either empty or fill the jar's chambers 30 with particular items. In this regard, the tab member 74 is readily grasped between a person's thumb and forefinger of one hand while the jar portion is being grasped in the other hand, such that when the person pulls upwardly on the tab member using a moderate amount of force, the annular projection 56 of the jar portion disengages the annular notch 54 in the lid, resulting in the lid pulling free and away from the jar portion. The lid is re-secured to the jar portion by placing the lid directly over the open top surface of the jar portion and then pressing downward on the lid's top wall to cause the annular projection 56 to snap into and engage the notch 54.

Referring to FIG. 2, the jar portion also includes an annular, downwardly extending leg 76. The leg 76 is arranged to support the container 20' on a generally horizontal surface (e.g., on a shelf) and is connected to the bottom wall 32 of the jar portion adjacent its periphery, so as to be generally concentric with the jar portion's sidewall 34.

In the preferred embodiment of the invention, the lid as well as the jar portion are plastic and are each integrally formed as single units using an internal injection molding process. Obviously, other materials and methods of forming these members can also readily be used. It should still further be mentioned that in the preferred embodiment of the invention, the jar portion, including the partitioning walls 38, is translucent, to permit the container's contents to be viewed without having to remove the lid from the jar portion.

As can readily be appreciated from the foregoing discussion, the container 20 is simple and inexpensive to produce and provides convenient means for both storing and dispensing a plurality of different types of pills or other items.

Without further elaboration the foregoing will so fully illustrate my invention that others may, by applying current or future knowledge, readily adapt the same for use under various conditions of service.

I claim:

1. A partitioning dispensing container for separately storing and dispensing a plurality of different groups of individual items, said container being in the form of a hollow jar having a cylindrically shaped sidewall, a bottom wall, an open top, and a plurality of vertically disposed partitioning walls dividing the jar's interior space into a plurality of separate chambers, with each chamber being adapted to receive and hold therein plural items to be dispensed, said sidewall having a top edge and including a plurality of passages located about the periphery thereof adjacent said top edge, each of said passages being disposed between an immediately adjacent pair of said partitioning walls, said container further including lid means releasably and rotatably mounted on said jar portion adjacent the top to close the jar's chambers, each of said partitioning walls including a generally horizontal edge adjacent the open top of said jar, said lid means including a top wall and an annular sidewall, said sidewall including a dispensing slot of a sufficient size to enable any item disposed within any chamber to pass therethrough to enable an item to be dispensed from a selected chamber when the lid means is rotatably positioned so that said slot overlies the associated passage in said chamber, while the annular sidewall portions of the lid means close the other passages, thereby precluding dispensing of items therefrom, the container further comprising alignment means for facilitating the process of aligning the dispensing slot with respective passages , said alignment means including engagement means on said lid means, said engagement means comprising a pair of adjacent rib members arranged to receive therebetween and engage respective top edges of said partitioning walls when the cap means is rotated to a first position to align the dispensing slot with one of said passages, while resisting accidental rotational movement of the lid means with respect to the said jar which would tend to misalign said slot and said passage, said engagement means being releasable by the application of additional rotary force to said lid means to cause said rib members to be disengaged from the edge located therebetween, thereby enabling said lid means to rotate to a second position of alignment between another one of said passages and the dispensing slot, thus permitting access to another of the chambers.

2. The container of claim 1 wherein said rib members are elongated beveled members extending generally parallel to each other radially intermediate the top wall's periphery and center, each of said horizontal edges of said partitioning walls being a convex rounded surface so that any of said edges can be readily fit between and engaged by said rib members and readily disengaged from said members.

3. The container of claim 1 wherein said container further comprises releasable connecting means for releasably connecting said lid means to said jar, said releasable connecting means includ ing an annular projection and a corresponding annular recess adapted to receive said projection, whereupon said projection and said recess coact to both releasably secure and permit rotational movement of said lid means relative to said jar.

4. The container of claim 1 wherein said lid means further comprises a tab member, extending outward at right angles from said sidewall to facilitate manual removal of the lid means from said jar.

5. The container of claim 1 wherein said dispensing slot is only slightly larger than the size of a typical item dispensed from said container, and wherein each of said passages in said jar is only slightly larger than a typical item dispensed from said container so as to permit only one item at a time to be dispensed therethrough.

6. The container in claim 1 wherein said jar is constructed of a translucent plastic material, to permit the items located therein to be viewed without having to remove the lid means from the jar.

7. The container of claim 1 wherein the annular sidewall of said lid means further comprises plural, vertically extending gripping ribs on its exterior surface.

* * * * *